US007985711B2

(12) United States Patent
Tohmatsu et al.

(10) Patent No.: US 7,985,711 B2
(45) Date of Patent: Jul. 26, 2011

(54) THERMOSENSITIVE RECORDING MATERIAL AND RECORDING METHOD USING THE SAME

(75) Inventors: Hiroshi Tohmatsu, Numazu (JP); Hideo Aihara, Fuji (JP); Shinji Okada, Shizuoka (JP); Ichiro Sawamura, Numazu (JP); Hirokazu Watari, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 812 days.

(21) Appl. No.: 12/013,555

(22) Filed: Jan. 14, 2008

(65) Prior Publication Data

US 2008/0182749 A1 Jul. 31, 2008

(30) Foreign Application Priority Data

Jan. 15, 2007 (JP) ..... 2007-005314

(51) Int. Cl.
*B41M 5/41* (2006.01)

(52) U.S. Cl. ..... 503/201; 503/200

(58) Field of Classification Search ..... None
See application file for complete search history.

(56) References Cited

U.S. PATENT DOCUMENTS 4,950,638 A * 8/1990 Yuyama et al.
4,975,408 A * 12/1990 Motosugi et al.
5,102,693 A * 4/1992 Motosugi et al.
5,189,007 A * 2/1993 Aihara et al.
5,229,349 A * 7/1993 Kurisu et al.
5,447,899 A * 9/1995 Matoba et al. ..... 503/200
5,482,911 A * 1/1996 Hiroishi et al.
5,712,221 A * 1/1998 Goto et al.
5,792,724 A * 8/1998 Suzaki et al.
5,866,504 A * 2/1999 Okada et al.
5,866,507 A * 2/1999 Suzaki et al.
5,866,508 A * 2/1999 Sawamura et al.
5,935,899 A * 8/1999 Suzaki et al.
5,952,263 A * 9/1999 Suzaki et al.
5,985,791 A * 11/1999 Okada
6,319,878 B1 * 11/2001 Ina et al.
RE38,496 E * 4/2004 Sawamura et al.

FOREIGN PATENT DOCUMENTS

JP 3-190787 * 8/1991
JP 7-81231 * 3/1995
JP 2919062 * 4/1999
JP 3248993 * 11/2001
JP 3497699 * 11/2003

* cited by examiner

*Primary Examiner* — Bruce H Hess
(74) *Attorney, Agent, or Firm* — Cooper & Dunham LLP

(57) ABSTRACT

To provide a thermosensitive recording material that is superior in uniformity, makes it possible to obtain images with high glossiness and has less curl, in which a synthetic paper having a multilayer structure serves as a support. Specifically, there is a thermosensitive recording material including: a support, and a thermosensitive recording layer containing a leuco dye and a color developer on the support, wherein the support is a synthetic paper having a multilayer structure, and an inorganic pigment is contained only in a base layer of the synthetic paper; also, two layers which are formed solely of polypropylene and which contain no inorganic pigment are laid one on top of the other on the base layer containing an inorganic pigment; further, all layers are biaxially stretched.

12 Claims, 1 Drawing Sheet

THERMOSENSITIVE RECORDING MATERIAL AND RECORDING METHOD USING THE SAME

BACKGROUND

1. Technical Field

This disclosure relates to a thermosensitive recording material utilizing a color-developing reaction between an electron-donating coloring compound and an electron-accepting compound, or the like, more specifically, to a thermosensitive recording material for medical images.

2. Description of the Related Art

A thermosensitive recording medium is generally formed by providing on one surface of a support made of paper, synthetic paper or plastic film a thermosensitive color-developing layer composed mainly of a colorless or pale color-developing substance such as an electron-donating leuco dye, an organic acid color developer such as an electron-accepting phenolic compound, and a binder. It is possible to obtain a color-developing recording image by making the color-developing dye and the color developer react together utilizing thermal energy. Thermosensitive recording media like this are advantageous in that recording apparatuses for the thermosensitive recording media are compact and inexpensive, offer good maintainability and so forth; thus, the thermosensitive recording media are widely used for electronic calculators, facsimiles, automated ticketing machines, scientific measurers, CAD printers, plotters, printers for CRT medical measurement, and the like.

Amongst those uses, in the case of use where water resistance and tensile strength are required, in the case of use in image printers for CRT medical measurement where uniformity and high resolution of recorded images are required, and in the case of use in CAD plotters where dimension stability and thin line recording are required, thermosensitive papers are used in which synthetic paper having multilayer structure serves as a support.

In the field of medical treatment, states of the inside of bodies viewed using X-rays, MRI, CT scans, etc. have been made visible images on silver halide-based film, and those images have been looked at for visual diagnosis and referred to by means of backlight employed by view boxes. However, the wet process for the silver halide-based film has a problem with waste liquid disposal; further, along with the recent digitization of images, emergence of a dry process that replaces it has been demanded, and thermosensitive recording systems have already begun being used for reference in monitor diagnosis with digital images or for visual diagnosis with output of digital images as well as for CRT medical measurement.

Thermosensitive recording materials for medical uses are generally classified into the reflective type in which recording material has little or no light transmittance as a whole and a formed image is viewed by means of reflection of light, and the transmissive type in which recording material has light transmittance as a whole and the light transmittance is utilized; the present invention relates to the reflective type in which a formed image is viewed by means of reflection of light.

The characteristics required to allow for an image on thermosensitive paper to be used as a reflective-type medical image which is to be referred to or looked at for visual diagnosis include uniformity, high resolution, thin line recording, high glossiness, water resistance, curl reduction, measurement stability and tensile strength of a recorded image; therefore, a synthetic paper having a multilayer structure is used as a support.

However, synthetic papers having multilayer structure for thermosensitive papers used for electronic calculators, facsimiles, automated ticketing machines, scientific measurers, CAD printers and plotters are provided with concavities and convexities on their surfaces to improve printing suitability and writing quality that are necessary properties, and some of the convexities are protrusions of unsuitable height for support of thermosensitive recording media for reflective-type medical images. When a medical image is recorded onto a thermosensitive recording paper using any such support, there are problems caused in which white spots arise at halftone portions and solid image recording portions, so that uniformity decreases and so forth. Also, there is a problem in which the provision of concavities and convexities on a surface of a synthetic paper contributes to the lowering of glossiness, and high glossiness that a thermosensitive paper for reflective-type medical treatment is required to have so as to produce a photograph-like image cannot be yielded. Moreover, although the concavities and convexities are provided on the surface of the synthetic paper having a multilayer structure, the opposite surface thereof does not have the same structure, and thus there is greater curl when the synthetic paper is formed into a sheet, which is problematic when a medical image is observed.

In order to remove the white spots at the halftone portion and the solid image recording portion, Japanese Patent Application Laid-Open (JP-A) No. 3-190787 proposes and puts into practice a thermosensitive recording paper including: a support made of synthetic paper, and a thermosensitive color-developing layer on the support, wherein the support is a synthetic paper formed of a laminated film including a biaxially-stretched resinous film as a base layer and also including a uniaxially-stretched film of thermoplastic resin containing 10% by mass to 50% by mass of calcium carbonate powder as a paper-like layer on the front surface of this base layer, and the support satisfies the following properties (i) to (iii). (i) the opacity measured in accordance with JIS P-8138 is 45% or less; (ii) the Bekk smoothness of the paper-like layer onto which the thermosensitive color-developing layer is applied is 100 sec to 300 sec, and the center line average roughness (Ra) thereof is 1.5 μm or less; and (iii) the density of the support measured in accordance with JIS P-8118 is 1.1 g/cm$^3$ or less.

Meanwhile, JP-A No. 07-81231 proposes a thermosensitive recording paper including: a support made of synthetic paper, and a thermosensitive color-developing layer on one surface of the support, wherein the support is a synthetic paper formed of a laminated film including a biaxially-stretched resinous film as a base layer, also including a paper-like layer formed of a uniaxially-stretched film of thermoplastic resin containing 1% by mass to 8% by mass of calcium carbonate powder on one surface of this base layer, and further including a back surface layer formed of a uniaxially-stretched film of thermoplastic resin containing 15% by mass to 55% by mass of inorganic fine powder on the other surface of the base layer, and the support satisfies the following properties (i) to (iv): (i) the opacity measured in accordance with JIS P-8138 is 45% or less; (ii) the Bekk smoothness of the paper-like layer onto which the thermosensitive color-developing layer is applied is 1,000 sec to 3,500 sec, and the center line average roughness (Ra) thereof is 0.5 μm or less; (iii) the Bekk smoothness of the back surface layer is 100 sec to 900 sec, and the center line average roughness (Ra) thereof is 0.6 μm to 1 μm; and (iv) the density of the support measured in accordance with JIS P-8118 is 0.91 g/cm$^3$ to 1.1 g/cm$^3$.

These supports can remove the problems to some extent in which protrusions of unsuitable height cause white spots to arise at halftone portions and solid image recording portions, so that uniformity decreases and so forth; however, they do not sufficiently meet requirements of reflective-type medical images, and high image glossiness required cannot be obtained either. Moreover, since the front and back of the base layer have different structures, there is greater curl.

BRIEF SUMMARY

In an aspect of this disclosure, there is provided a thermosensitive recording material which is superior in uniformity, makes it possible to obtain images with high glossiness and has less curl, wherein a synthetic paper having a multilayer structure serves as a support.

In another aspect of this disclosure, there is provided a thermosensitive recording material which is superior in uniformity and makes it possible to obtain images with high glossiness, by means of a thermosensitive recording material including: a support, and a thermosensitive recording layer containing a leuco dye and a color developer on the support, wherein the support is a synthetic paper having a multilayer structure, and an inorganic pigment is contained only in a base layer. The synthetic paper having a multilayer structure, which is used as the support, in the present invention will be explained in detail.

DETAILED DESCRIPTION OF THE INVENTION

Figure 1A:
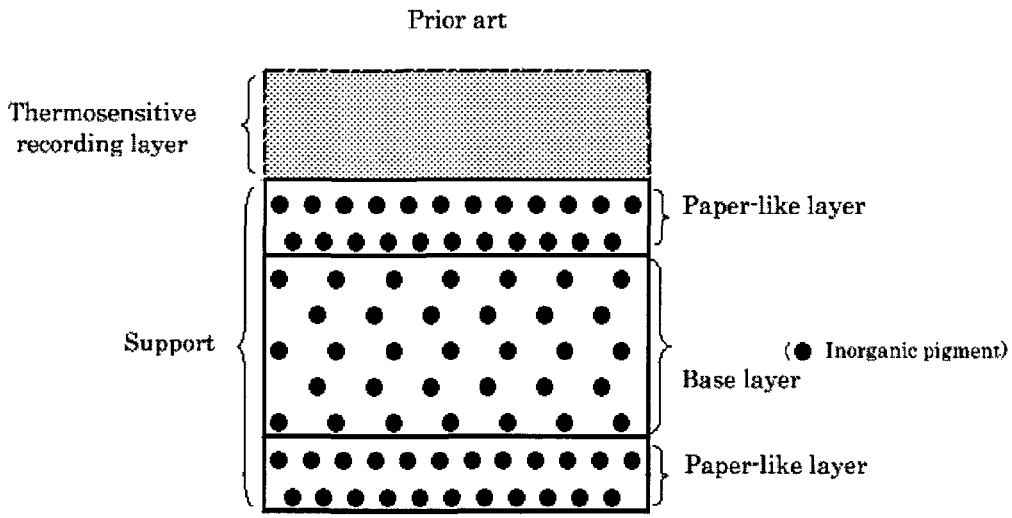
FIG. 1A is a schematic diagram for explaining a support layer and a thermosensitive recording layer in related art.
Figure 1B:
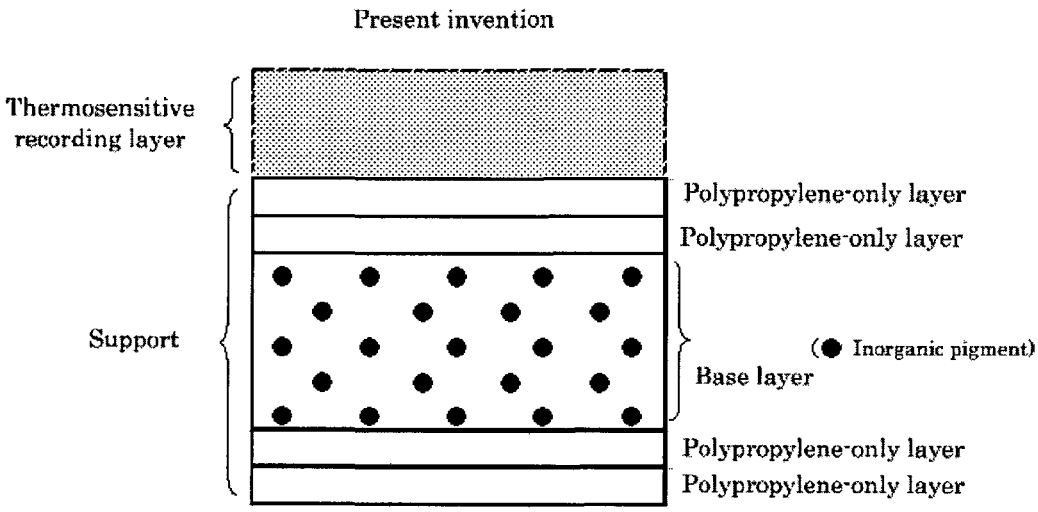
FIG. 1B is a schematic diagram for explaining a support layer and a thermosensitive recording layer in the present invention.

Examples of thermoplastic resins which constitute layers of a support include polyolefin resins such as polyethylene, polypropylene, ethylene-propylene copolymer, ethylene-vinyl acetate copolymer, poly(4-methylpentene-1), polystyrene, polyamide, polyethylene terephthalate, partial hydrolysate of ethylene-vinyl acetate copolymer, ethylene-acrylic acid copolymer, and salt of ethylene-acrylic acid copolymer; vinylidene chloride copolymers such as vinyl chloride-vinylidene chloride copolymer; some others and mixtures thereof.

Next, each layer will be explained. (1) Base layer: what is used for a base layer is a film produced by biaxially stretching a composition composed of (a) 50% by mass to 95% by mass of polypropylene, (b) 0% by mass to 30% by mass of one or more thermoplastic resins selected from high-density polyethylene, medium-density polyethylene, low-density polyethylene and ethylene-vinyl acetate copolymer, and (c) 50% by mass to 5% by mass of inorganic fine powder. By forming the base layer of a biaxially-stretched film, the base layer changes in shape more evenly in longitudinal and lateral directions and is therefore favorable in terms of reducing curl. The inorganic fine powder is exemplified by calcium carbonate, fired clay, diatomaceous earth, talc, titanium oxide, barium sulfate, aluminum sulfate and silica, all of which are 20 μm or less in average particle diameter.

(2) Front surface layer: a front surface layer is a composition composed of (a) 40% by mass to 100% by mass of polypropylene and (b) 60% by mass to 0% by mass of high-density polyethylene; in order to enhance its glossiness and smoothness, it is desirable that the front surface layer be a thin film of 0.5 μm to 10 μm in thickness made solely of polypropylene, and further, that the front surface layer be formed by laying two such thin layers one on top of the other. It is desirable that the front surface layer be formed of a biaxially-stretched film because it can offer higher glossiness. Also, it is desirable in view of reducing curl that layers of the same structure be formed on both front and back surfaces of the base layer.

Next, the thickness of each layer of the support will be explained. It is appropriate that the thickness of a synthetic paper with a multilayer structure be 40 μm to 800 μm, preferably 60 μm to 300 μm. The base layer occupies 40% or more of the thickness of the synthetic paper. The front surface layer and the back surface layer are made 0.5 μm to 10 μm in thickness each. Pores are provided in the synthetic paper to such an extent that the porosity defined by the following equation becomes 15% to 65%. The draw ratio is 4 to 10 in the longitudinal direction and 4 to 12 in the lateral direction, and the stretching temperature is 140° C. to 158° C. with respect to longitudinal stretching and is higher than the melting point (163° C. to 168° C.) of polypropylene with respect to lateral stretching. Porosity=$(\rho 0-\rho 1)/\rho 0\times 100(\%)$ where $\rho 0$: film density before stretching, and $\rho 1$: film density after stretching Also, it is desirable in view of reducing curl that the draw ratio for biaxial stretching be adjusted so as to set the MD (longitudinal)/CD (lateral) ratio of the rigidity of the support in the range of 0.6 to 1.4. It is further desirable in view of reducing curl that both MD (longitudinal) and CD (lateral) of the rigidity of the support be set at 500±150 mg.

The thermosensitive recording material of the present invention is formed by providing on the above-delineated support a thermosensitive recording layer, and further, an intermediate layer and/or a protective layer according to necessity. Leuco dyes used in the thermosensitive recording layer of the present invention are applied alone or in combination; for such leuco dyes, any leuco dyes used in thermosensitive materials of this kind can be used. For example, leuco compounds of dyes such as triphenylmethane dyes, fluoran dyes, phenothiazine dyes, auramine dyes, spiropyran dyes and indolinophthalide dyes can be suitably used. Specific examples of such leuco dyes include the following.

3,3-bis(p-dimethylaminophenyl)-phthalide,
3,3-bis(p-dimethylaminophenyl)-6-dimethylaminophthalide (also known as crystal violet lactone),
3,3-bis(p-dimethylaminophenyl)-6-diethylaminophthalide,
3,3-bis(p-dimethylaminophenyl)-6-chlorphthalide,
3,3-bis(p-dibutylaminophenyl)phthalide,
3-cyclohexylamino-6-chlorfluoran,
3-dimethylamino-5,7-dimethylfluoran, 3-diethylamino-7-chlorofluoran,
3-diethylamino-7-methylfluoran, 3-diethylamino-7,3-benzfluoran,
3-diethylamino-6-methyl-7-chlorfluoran,
3-(N-p-tolyl-N-ethylamino)-6-methyl-7-anilinofluoran,
3-pyrrolidino-6-methyl-7-anilinofluoran,
2-{N-(3'-fluortrimethylphenyl)amino}-6-diethylaminofluoran,
2-{3,6-bis(diethylamino)-9-(O-chloranilino) xanthyl benzoic acid lactam},
3-diethylamino-6-methyl-7-(m-trichloromethylanilino)fluoran,
3-diethylamino-7-(O-chloranilino)fluoran, 3-di-n-butylamino-7-(O-chloranilino)fluoran,
3-N-methyl-N-n-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino) fluoran, benzoyl leucomethylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorphenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chlor-5'-methylphenyl)phthalide,
3-(N-ethyl-N-tetrahydrofurfuryl)amino-6-methyl-7-anilinofluoran,
3-N-ethyl-N-(2-ethoxypropyl)amino-6-methyl-7-anilinofluoran,
3-N-methyl-N-isobutyl-6-methyl-7-anilinofluoran,
3-morpholino-7-(N-propyl-trifluoromethylanilino)fluoran,
3-pyrrolidino-7-m-trifluoromethylanilinofluoran,
3-diethylamino-5-chloro-7-(N-benzyl-trifluoromethylanilino)fluoran,
3-pyrrolidino-7-(di-p-chlorphenyl)methylaminofluoran,
3-diethylamino-5-chlor-7-(α-phenylethylamino)fluoran,
3-(N-ethyl-p-toluidino)-7-(α-phenylethylamino)fluoran,
3-diethylamino-7-(O-methoxycarbonylphenylamino)fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)fluoran,
3-(N-methyl-N-isopropylamino)-6-methyl-7-anilinofluoran,
3-di-n-butylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chlor-7-anilinofluoran,
3-diethylamino-6-methyl-7-mesitydino-4',5'-benzofluoran,
3-N-methyl-3-isopropyl-8-methyl-7-anilinofluoran,
3-N-ethyl-N-isoamyl-6-methyl-7-anilinofluoran and
3-diethylamino-6-methyl-7-(2',4'-dimethylanilino) fluoran.

To a color developer used in the thermosensitive recording layer of the present invention, a variety of electron-accepting substances which react with the leuco dyes when heated and which make them develop color can be applied; specific examples thereof include the following phenolic substances, organic or inorganic acid substances, and esters or salts thereof. Gallic acid, salicylic acid,
3-isopropylsalicylic acid, 3-cyclohexylsalicylic acid,
3,5-di-tert-butylsalicylic acid, 3,5-di-α-methylbenzylsalicylic acid,
4,4'-isopropylidenediphenol, 1,1'-isopropylidenebis(2-chlorophenol),
4,4'-isopropylidenebis(2,6-dibromophenol),
4,4'-isopropylidenebis(2,6-dichlorophenol),
4,4'-isopropylidenebis(2-methylphenol),
4,4'-isopropylidenebis(2,6-dimethylphenol),
4,4-isopropylidenebis(2-tert-butylphenol), 4,4'-sec-butylidenediphenol,
4,4'-cyclohexylidenebisphenol,
4,4'-cyclohexylidenebis(2-methylphenol), 4-tert-butylphenol,
4-phenylphenol, 4-hydroxydiphenoxide, α-naphthol, β-naphthol,
3,5-xylenol, thymol, methyl-4-hydroxybenzoate,
4-hydroxyacetophenone, novolac-type phenolic resins,
2,2'-thiobis(4,6-dichlorophenol), catechol, resorcin, hydroquinone,
pyrogallol, phloroglycine, phloroglycinecarboxylic acid,
4-tert-octylcatechol, 2,2'-methylenebis(4-chlorophenol),
2,2'-methylenebis(4-methyl-6-tert-butylphenol),
2,2-dihydroxydiphenyl, ethyl p-hydroxybenzoate, propyl p-hydroxybenzoate, butyl p-hydroxybenzoate, benzyl p-hydroxybenzoate, p-hydroxybenzoic acid-p-chlorobenzyl,
p-hydroxybenzoic acid-o-chlorobenzyl, p-hydroxybenzoic acid-p-methylbenzyl, p-hydroxybenzoic acid-n-octyl, benzoic acid, zinc salicylate, 1-hydroxy-2-naphthoic acid, 2-hydroxy-6-naphthoic acid,
2-hydroxy-6-naphthoic acid zinc, 4-hydroxydiphenylsulfone,
4-hydroxy-4'-chlorodiphenylsulfone, bis(4-hydroxyphenyl) sulfide,
2-hydroxy-p-toluic acid, 3,5-di-tert-butylsalicylic acid zinc,
3,5-di-tert-butylsalicylic acid tin, tartaric acid, oxalic acid, maleic acid,
citric acid, succinic acid, stearic acid, 4-hydroxyphthalic acid, boric acid, thiourea derivatives, 4-hydroxythiophenol derivatives,
bis(4-hydroxyphenyl)acetic acid, bis(4-hydroxyphenyl)ethyl acetate,
bis(4-hydroxyphenyl)n-propyl acetate, bis(4-hydroxyphenyl)m-butyl acetate, bis(4-hydroxyphenyl)phenyl acetate,
bis(4-hydroxyphenyl)benzyl acetate, bis(4-hydroxyphenyl) phenethyl acetate, bis(3-methyl-4-hydroxyphenyl)acetic acid,
bis(3-methyl-4-hydroxyphenyl)methyl acetate,
bis(3-methyl-4-hydroxyphenyl)n-propyl acetate,
1,7-bis(4-hydroxyphenylthio) 3,5-dioxaheptane,
1,5-bis(4-hydroxyphenylthio) 3-oxaheptane, 4-hydroxyphthalic acid dimethyl, 4-hydroxy-4'-methoxydiphenylsulfone,
4-hydroxy-4'-ethoxydiphenylsulfone,
4-hydroxy-4'-isopropoxydiphenylsulfone,
4-hydroxy-4'-propoxydiphenylsulfone,
4-hydroxy-4'-butoxydiphenylsulfone,
4-hydroxy-4'-isobutoxydiphenylsulfone,
4-hydroxy-4-butoxydiphenylsulfone,
4-hydroxy-4'-tert-butoxydiphenylsulfone,
4-hydroxy-4'-benzyloxydiphenylsulfone,
4-hydroxy-4'-phenoxydiphenylsulfone,
4-hydroxy-4'-(m-methylbenzyloxy)diphenylsulfone,
4-hydroxy-4'-(p-methylbenzyloxy)diphenylsulfone,
4-hydroxy-4'-(O-methylbenzyloxy)diphenylsulfone and
4-hydroxy-4'-(p-chlorobenzyloxy)diphenylsulfone.

In the thermosensitive recording layer of the present invention, together with the leuco dyes and the color developers, it is possible to use supplemental additives that are conventionally used for this kind of thermosensitive recording material, such as a water-soluble polymer and/or aqueous emulsion resin, a filler, a thermally fusible material and a surfactant according to necessity. In this case, examples of the filler include inorganic fine powders of calcium carbonate, silica, zinc oxide, titanium oxide, aluminum hydroxide, zinc hydroxide, barium sulfate, clay, talc, surface-treated potassium and surface-treated silica; and organic fine powders of urea-formalin resin, styrene-methacrylic acid copolymer and polystyrene resin. Examples of the thermally fusible material include higher fatty acids or esters thereof, amides or metal salts, waxes, condensation products of aromatic carboxylic acids with amines, benzoic acid phenyl ester, higher normal glycols, 3,4-epoxy-dialkyl hexahydrophthalate, higher ketones, p-benzylbiphenyl and other thermally fusible organic compounds having melting points of approximately 50° C. to 200° C.

The thermosensitive recording layer of the present invention is produced by homogeneously dispersing or dissolving a leuco dye, a color developer and the like in a binder resin, applying this mixture solution onto a support and drying the solution, but the coating method is not particularly limited and can be selected from a dye fountain method, a wire bar method, a gravure method, an air knife method and the like. Amongst these methods, a dye fountain method, in which a coating layer can be applied onto a support without a coater making direct contact with the support, is favorable in that the coating layer can gain uniformity. The particle diameter of the dispersed materials in the recording layer solution affects the glossiness of the recording material as a whole, the surface roughness of the protective layer, dot reproducibility at the time of printing, and image uniformity. It is desirable that the volume average particle diameter of the dispersed materials in the recording layer solution be 2.0 μm or less, particularly 1.0 μm or less. As for the glossiness of the recording layer surface, when the surface glossiness (GS (75°)) measured in accordance with JIS-P-8142 is made equal to or greater than 40%, the glossiness of the recording material as a whole and image uniformity improve dramatically. Although the thickness of the recording layer depends upon the composition of the recording layer and how the thermosensitive recording material is used, it is preferably 1 μm to 50 μm or so, more preferably 3 μm to 20 μm or so.

Regarding the thermosensitive recording material of the present invention, it is possible to provide the protective layer on the thermosensitive recording layer for the purpose of, for example, improving matching quality between the thermosensitive recording material and a thermal head or the like, and enhancing recorded image storage quality further, which is very preferable. In this case, examples of resins forming the protective layer include polyvinyl alcohol, cellulose derivatives, starch and derivatives thereof, carboxyl-modified polyvinyl alcohol, polyacrylic acid and derivatives thereof, styrene/acrylic acid copolymer and derivatives thereof, poly (meth)acrylamide and derivatives thereof, styrene/acrylic acid/acrylamide copolymer, amino-modified polyvinyl alcohol, epoxy-modified polyvinyl alcohol, polyethyleneimine, aqueous polyester, aqueous polyurethane, water-soluble resins such as isobutylene/maleic anhydride copolymer and derivatives thereof, polyester, polyurethane, acrylic acid ester copolymer/polymer, styrene/acrylic copolymer, epoxy resin, polyvinyl acetate, polyvinylidene chloride, polyvinyl chloride and copolymers thereof. Amongst these, the water-soluble resins are preferable, and diacetone-modified polyvinyl alcohol is more preferable; further, it is desirable that a hydrazide compound be used as a cross-linking agent for those substances. Besides the resins, conventional supplemental additives such as a filler, a surfactant, a thermally fusible material (or a lubricant), a pressure-related color developing preventive agent and the like can also be used in the protective layer; further, a water-resisting agent can be contained therein. In this case, specific examples of the filler and the thermally fusible material include substances which are similar to the ones shown as examples in the disclosure of the thermosensitive protective layer.

The protective layer can be applied in accordance with any conventionally known method, without any limitation in particular. The thickness of the protective layer is preferably 0.1 μm to 20 μm, more preferably 0.5 μm to 10 μm. When the protective layer is too thin, it does not sufficiently function as a protective layer, as it fails to improve a recording medium's storage quality and head-matching quality, etc.; when the protective layer is too thick, the thermal sensitivity of the recording medium lowers and the protective layer is also disadvantageous in terms of cost.

Regarding the thermosensitive recording material of the present invention, it is possible to provide the intermediate layer between the thermosensitive recording layer and the protective layer for the purpose of, for example, improving water resistance and chemical resistance. In this case, as with the resins mentioned for the protective layer, examples of resins forming the intermediate layer include polyvinyl alcohol, cellulose derivatives, starch and derivatives thereof, carboxyl-modified polyvinyl alcohol, polyacrylic acid and derivatives thereof, styrene/acrylic acid copolymer and derivatives thereof, poly(meth)acrylamide and derivatives thereof, styrene/acrylic acid/acrylamide copolymer, amino-modified polyvinyl alcohol, epoxy-modified polyvinyl alcohol, polyethyleneimine, aqueous polyester, aqueous polyurethane, water-soluble resins such as isobutylene/maleic anhydride copolymer and derivatives thereof, polyester, polyurethane, acrylic acid ester copolymer/polymer, styrene/acrylic copolymer, epoxy resin, polyvinyl acetate, polyvinylidene chloride, polyvinyl chloride and copolymers thereof.

It is possible for the intermediate layer to contain a surfactant, and further, a cross-linking agent, in addition to the resin. The intermediate layer can be applied in accordance with a conventionally known method, without any limitation in particular. The thickness of the intermediate layer is preferably 1 μm to 5 μm, more preferably 2 μm to 3 μm. When the intermediate layer is too thin, it does not sufficiently function as an intermediate layer, as it fails to improve water resistance, chemical resistance, etc.; when the intermediate layer is too thick, the thermal sensitivity of a recording medium lowers and the intermediate layer is also disadvantageous in terms of cost.

In order for a recording material to be conveyed more smoothly at the time of printing with an imager by reducing curl of the recording material as well as to make the recording material less adhesive, it is desirable that the back surface of the support be provided with a back layer containing a matting agent formed of fine particles. Additionally, when the matting agent is formed of inorganic fine particles, the recording material is easily caused to have scratches as it rubs against the inorganic fine particles; accordingly, resin fine particles are employed to prevent the scratches caused by the rubbing and to enhance adhesion. Examples of the resin fine particles include cross-linked polystyrene resin, urea-formalin resin, silicone resin, cross-linked polymethylmethacrylate acrylate resin and melamine-formaldehyde resin. The average diameter of the resin fine particles is preferably 20 μm or less. When it is greater than 20 μm, protrusions on the surface of the back layer become conspicuous and thus appearance-related quality is poor. It is more preferably 10 μm to 15 μm. Additionally, when it is 5 μm or less, there is less improvement in adhesion. The added amount of resin fine particles is 0.5% by mass to 10% by mass to the amount of the resin forming the back layer; when it is greater than 10% by mass, transparency is impaired, and when it is less than 0.5% by mass, there is less improvement in adhesion. It is preferably 1% by mass to 5% by mass or so.

As to a method for forming images with the use of the thermosensitive recording material of the present invention, the thermosensitive recording material is heated imagewise by a heating unit on the basis of information concerning letters/characters and/or shapes. The heating unit is not particularly limited and can be selected from a thermal pen, a thermal head, a laser heating device and the like according to the purpose of use; however, it is most desirable to form images using a thermal head in terms of the fact that the thermosensitive recording material of the present invention is suitable for high-resolution, high-tone images, particularly medical images and the like, and also in terms of the cost of an apparatus, output speed and compactness. In view of medical uses, it is necessary for images to have a grayscale, and the images may be given a grayscale by means of a pulse control method or a voltage control method.

The present invention can provide a thermosensitive recording material which is superior in uniformity, makes it possible to obtain images with high glossiness and has less curl, wherein a synthetic paper having a multilayer structure serves as a support.

EXAMPLES

The following explains the present invention in further detail by referring to Examples; however, the present invention is not limited by these Examples in any way. Note that the term "part" and the symbol "%" used below are both based upon mass.

Example 1

(1) Base Film A

The base film used was a five-layer synthetic paper formed of (i) and (ii) below, and the base film was 188 μm±5 μm in thickness, 95% in surface glossiness, 11,000 sec in smoothness, and 400 mg (MD) and 600 mg (CD) in rigidity.

(i) Base layer: a layer of 178 μm in thickness formed by biaxially stretching a composition composed of 95% of polypropylene and 5% of calcium carbonate of 1 μm in average particle diameter was made a base layer.

(ii) Front surface layer: a film of 2 μm in thickness formed by biaxially stretching polypropylene and a film of 3 μm in thickness formed by biaxially stretching polypropylene were laid one on top of the other on the base layer to yield a front surface layer of a two-layer structure. Also, a layer having the same structure as that of the front surface layer was formed on the back surface of the base layer.

(2) Preparation of Thermosensitive Recording Layer Coating Solution

[A Solution] Preparation of Dye Dispersion Solution

| | |
|---|---|
| 2-anilino-3-methyl-6-dibutylaminofluoran: | 20 parts |
| 10% aqueous solution of polyvinyl alcohol: | 20 parts |
| water: | 60 parts |

[B Solution] Color Developer Dispersion Solution

| | |
|---|---|
| 4-hydroxy-4'-isopropoxydiphenylsulfone: | 12 parts |
| silica: | 4 parts |
| stearic acid amide: | 4 parts |
| 10% aqueous solution of polyvinyl alcohol: | 20 parts |
| water: | 60 parts |

[C Solution] Thermosensitive Recording Layer Solution

| | |
|---|---|
| A solution: | 12.5 parts |
| B solution: | 62.5 parts |
| 10% aqueous solution of polyvinyl alcohol: | 25 parts |

An [A solution] and a [B solution] were prepared by pulverizing with a magnetic ball mill the components in the above-mentioned compositions so as to become 2.5 μm in average particle diameter. Subsequently, 12.5 parts of [A solution], 62.5 parts of [B solution] and 25 parts of modified polyvinyl alcohol (KURARAY K POLYMER KL-318 having a solid content of 10%) were mixed by agitation to prepare the thermosensitive recording layer solution [C solution]. A thermosensitive recording layer solution [C1 solution] was applied onto the base film A using a wire bar and then dried with a dryer at 70° C. for 3 min to form a thermosensitive recording layer A (having a surface glossiness of 43%) of 8.5 g/m$^2$ in thickness.

(3) Preparation of Top Layer Coating Solution

[D Solution] Filler Dispersion Solution

| | |
|---|---|
| calcium carbonate (Brt15): | 20 parts |
| 10% aqueous solution of polyvinyl alcohol: | 20 parts |
| water: | 60 parts |

[E Solution] Top Layer Solution

| | |
|---|---|
| core-shell resin (20% solution of BARIASTAR B produced by Mitsui Chemicals, Inc.): | 30 parts |
| zinc stearate emulsion solution (0.2 μm in volume average particle diameter, K-994 having a solid content of 20% produced by Chukyo Yushi Co., Ltd.): | 7 parts |
| filler dispersion solution (D solution) (0.2 μm in volume average particle diameter): | 30 parts |
| water: | 66 parts |
| aziridine compound (CHEMITITE PZ-332 produced by Nippon Shokubai Co., Ltd.): | 2 parts |

[D solution] was prepared by pulverizing with a magnetic ball mill the components in the composition of [D solution] so as to become 0.2 μm in volume average particle diameter, and then the components in the composition of [E solution] were mixed by agitation to prepare the top layer solution [E solution]. Further, the top layer solution [E solution] was applied onto the recording layer A using a wire bar and then dried with a dryer at 70° C. for 3 min to form a top layer of 3 g/m$^2$ in thickness, and a sample of Example 1 was thus produced. The top layer surface glossiness of the sample of Example 1 was 68%.

Example 2

A sample of Example 2 was produced in the same manner as the one in Example 1, except that a thermosensitive recording layer solution [C2 solution] derived from the [A solution] and the [B solution] which were prepared so as to become 1.0 μm in average particle diameter was used. On this occasion, the surface glossiness of a thermosensitive recording layer B was 43%, and the top layer surface glossiness of the sample of Example 2 was 78%.

Example 3

(5) Preparation of Back Layer Coating Solution
[G Solution] Back Layer Solution

| | |
|---|---|
| water: | 45 parts |
| 10% aqueous solution of polyvinyl alcohol: | 40 parts |
| silica (P527 produced by Mizusawa Industrial Chemicals, Ltd.): | 1 part |
| antistatic agent (CHEMISTAT KM-7005): | 10 parts |
| polyamide epichlorohydrin (paper strength agent WS-525, 25%): | 4 parts |

[G solution] was applied onto the back surface side of the sample of Example 1 and dried to form a back layer of 4 g/m$^2$ in thickness, and a sample of Example 2 was thus produced.

Comparative Example 1

(1) Base Film B

The base film used was a three-layer synthetic paper formed of components (i) and (ii) below, and the base film was 180±5 μm in thickness, 60±10% in surface glossiness, 2,800 sec in smoothness, and 240 mg (MD) and 320 mg (CD) in rigidity.

(i) Base layer: a layer of 120 μm in thickness formed by biaxially stretching a composition composed of 80% of polypropylene and 20% of calcium carbonate of 1 μm in average particle diameter was made a base layer.

(ii) Paper-like layer: a film of 30 μm in thickness formed by uniaxially stretching a paper-like layer composed of 55% of polypropylene and 45% of calcium carbonate of 1 μm in average particle diameter was provided on the base layer. Also, a film having the same structure as that of the above-mentioned film was formed on the back surface of the base layer.

The same recording layer coating solution as the one used for Example 2 was applied onto the base film B using a wire bar and then dried with a dryer at 70° C. for 3 min to form a thermosensitive recording layer C (having a surface glossiness of 32%) of 8.5 g/m$^2$ in thickness. Further, the top layer solution [E solution] was applied onto the recording layer C using a wire bar and then dried with a dryer at 70° C. for 3 min to form a top layer of 3 g/m$^2$ in thickness, and a sample of Comparative Example 1 was thus produced. The top layer surface glossiness of the sample of Comparative Example 1 was 52%.

Comparative Example 2

(1) Base Film C

The base film used was a three-layer synthetic paper formed of (i) and (ii) below, and the base film was 195 μm±5 μm in thickness, 10%±5% in surface glossiness, 600 sec in smoothness, and 340 mg (MD) and 760 mg (CD) in rigidity.

(i) Base layer: a layer of 120 μm in thickness formed by biaxially stretching a composition composed of 80% of polypropylene and 20% of calcium carbonate of 1 μm in average particle diameter was made a base layer.

(ii) Paper-like layer: a film of 30 μm in thickness formed by uniaxially stretching a paper-like layer composed of 35% of polypropylene and 65% of calcium carbonate of 1 μm in average particle diameter was provided on the base layer. Also, a film having the same structure as that of the above-mentioned film was formed on the back surface of the base layer.

The thermosensitive recording layer solution [C solution] was applied onto the base film C using a wire bar and then dried with a dryer at 70° C. for 3 min to form a thermosensitive recording layer D (having a surface glossiness of 18%) of 8.5 g/m$^2$ in thickness. Further, the top layer solution [E solution] was applied onto the recording layer D using a wire bar and then dried with a dryer at 70° C. for 3 min to form a top layer of 3 g/m$^2$ in thickness, and a sample of Comparative Example 2 was thus produced. The top layer surface glossiness of the sample of Comparative Example 2 was 42%.

The values of physical properties of the samples of Examples and Comparative Examples thus produced were measured according to the following procedures.

1. Particle Diameter

The particle diameter of each sample was measured by a laser diffraction particle size analyzer LA-920 (refractive index 170a001) produced by Horiba, Ltd.

2. Glossiness

The glossiness of each sample was measured by a glossiness meter MODEL 1001DP 75° produced by Nippon Denshoku Industries Co., Ltd. The greater the value is, the higher the glossiness is.

3. Smoothness

The smoothness of each sample was measured by an Oken-type smoothness meter.

4. Rigidity

The rigidity of each sample was measured by a Gurley-type stiffness tester (when the sample was 1 inch in length, the distance of the measurement point from the axial center was 2 inches, and the load was 200 g).

Also, the thermosensitive recording materials of Examples and Comparative Examples thus produced were evaluated for (1) image uniformity and (2) curl.

(1) Image uniformity: solid images of 1.0 in reflection density were printed by an energy-variable dry imager HORIZON (produced by Codonics, Inc.) incorporating a tone head with a resolution of 300 dpi, and the uniformity of each solid image was judged by visual observation.

A: very uniform

B: uniform

C: not much uniform

D: extremely rough (2) Curl: after each sample had been cut into a sheet of the A4 paper size, the degrees of curl at its four corners were measured at 22° C. and at an RH of 50%, and the maximum value was employed. The greater the number is, the greater the curl is.

Result of Properties

| | Recording layer surface glossiness | Rigidity (MD) | Rigidity (CD) | Rigidity (MD/CD ratio) |
|---|---|---|---|---|
| Example 1 | 38% | 400 mg | 600 mg | 0.7 |
| Example 2 | 43% | 400 mg | 600 mg | 0.7 |
| Example 3 | 43% | 400 mg | 600 mg | 0.7 |
| Comparative Example 1 | 32% | 240 mg | 320 mg | 0.8 |
| Comparative Example 2 | 18% | 340 mg | 760 mg | 0.4 |

| Result of Evaluation | | |
|---|---|---|
| | Image uniformity | Curl |
| Example 1 | B | +5 |
| Example 2 | A | +5 |
| Example 3 | A | 0 |
| Comparative Example 1 | C | +6 |
| Comparative Example 2 | D | +12 |

What is claimed is:

1. A thermosensitive recording material comprising:

a support, and a thermosensitive recording layer containing a leuco dye and a color developer over the support, wherein the support is a synthetic paper having a multilayer structure formed mainly of a thermoplastic resin, wherein the synthetic paper comprises a base layer and further comprises two layers that are formed solely of polypropylene, that contain no inorganic pigment, and that are laid one on top of the other on the base layer containing an inorganic pigment, and wherein an inorganic pigment is contained only in the base layer of the synthetic paper.

2. The thermosensitive recording material according to claim 1, wherein all of the layers are biaxially stretched.

3. The thermosensitive recording material according to claim 1, wherein constituent materials of the thermosensitive recording layer over the support are 2.0 μm or less in average particle diameter.

4. The thermosensitive recording material according to claim 1, wherein the surface glossiness (GS (75°)) of the thermosensitive recording material measured in accordance with JIS-P-8142 is 40% or greater.

5. The thermosensitive recording material according to claim 1, wherein layers of the same structure which contain no inorganic pigment are laid on both surfaces of the base layer containing the inorganic pigment.

6. The thermosensitive recording material according to claim 5, wherein the MD/CD ratio of the rigidity of the support is 0.6 to 1.4.

7. The thermosensitive recording material according to claim 6, wherein both MD and CD values of the rigidity of the support are 500±150 mg.

8. The thermosensitive recording material according to claim 5, wherein a back layer containing a matting agent is provided on the back surface of the support.

9. A method for recording on the thermosensitive recording material according to claim 1, comprising:

heating the thermosensitive recording material to develop color, by the use of a printer incorporating a thermal head.

10. The method for recording according to claim 9, wherein the thermosensitive recording material is subjected to tone color developing by means of a pulse control method.

11. The method for recording according to claim 9, wherein the thermosensitive recording material is subjected to tone color developing by means of a voltage control method.

12. A thermosensitive recording material comprising:

a support, and a thermosensitive recording layer containing a leuco dye and a color developer over the support, wherein the support is a synthetic paper having a multilayer structure formed mainly of a thermoplastic resin, the synthetic paper comprising a base layer and further comprising two layers formed solely of polypropylene, and wherein said two layers formed solely of polypropylene contain no inorganic pigment, and are laid one on top of the other on the base layer.

* * * * *